United States Patent [19]

Potter et al.

[11] Patent Number: 4,955,826

[45] Date of Patent: Sep. 11, 1990

[54] CONNECTOR

[75] Inventors: Christopher M. Potter, Stevenage; George Hjipieris, Hitchin; Paul Bunyan, Letchworth, all of United Kingdom

[73] Assignee: Marconi Instruments Limited, Hertfordshire, United Kingdom

[21] Appl. No.: 337,216

[22] Filed: Apr. 12, 1989

[30] Foreign Application Priority Data

May 6, 1988 [GB] United Kingdom ..... 8810744

[51] Int. Cl.[5] ..... H01R 13/00

[52] U.S. Cl. ..... 439/578

[58] Field of Search ..... 439/578–585

[56] References Cited

U.S. PATENT DOCUMENTS

| | | | |
|---|---|---|---|
| 2,439,841 | 4/1948 | Carsten et al. | 439/578 |
| 3,292,117 | 12/1966 | Bryant et al. | 439/578 |
| 4,100,645 | 7/1978 | Meyers . | |

FOREIGN PATENT DOCUMENTS

| | | |
|---|---|---|
| 653884 | 5/1951 | United Kingdom . |
| 762188 | 11/1956 | United Kingdom . |
| 891611 | 3/1962 | United Kingdom . |
| 1001462 | 8/1965 | United Kingdom . |
| 1015688 | 1/1966 | United Kingdom . |
| 2143298 | 2/1985 | United Kingdom . |

*Primary Examiner*—Joseph H. McGlynn
*Attorney, Agent, or Firm*—Lowe, Price, LeBlanc, Becker & Shur

[57] ABSTRACT

In many microwave applications poor repeatability of results is often caused by differences in the quality of the coaxial connections. This invention overcomes the problem by ensuring more uniform connection by providing two mechanical connecting means radially separated from each other and coaxial with a central conducting means being connected, thus ensuring precise alignment of the two conductors.

8 Claims, 2 Drawing Sheets

CONNECTOR

BACKGROUND OF THE INVENTION

This invention relates to a connector. In particular, it relates to an electrical connector of the type used in microwave applications to connect, for instance, an instrument to a microwave or UHF coaxial cable.

Microwave coaxial connectors generally take the form of a hollow tubular connector surrounding and co-axial with an elongate central pin. The ratio of the diameters of the pin and the tube is kept to a particular chosen value dependent upon the electrical uses, but the diameter of the tube is chosen from several standardised values. The smaller the tube diameter, the higher the maximum permissible frequency of operation, but the less the mechanical durability of the connector. For most high frequency operations such connectors are adequate but when used in an application where many repeated connections are required such connectors can break with repeated handling.

A ruggedised system is known and comprises respective male and female connectors. The male connector includes a central pin having a narrowed end section surrounded by a tube, generally of 3.5 mm diameter. An outer nut, retained by the tube but rotatable thereon is provided and has an external 7 mm screw thread. The female connector of this ruggedised type of the prior art also includes a central pin which has a hollow section at its end for receiving the narrowed section of the male pin. This is again surrounded by a 3.5 mm tube and coaxially by a nut having a 7 mm internal thread which is adapted to co-operate with the equivalent male nut. Since the 7 mm type of nut can be considerably stronger than the more fragile 3.5 mm one a stronger more rugged connector is formed.

However, a major problem with this type of rugged connector is in its poor repeatability, which is largely due to the large distance between the mating plane (along the axis of the pins) and the connector thread. The present invention arose in an effort to design an improved connector which overcomes this drawback.

BRIEF SUMMARY OF THE INVENTION

According to the present invention in a first aspect there is provided means for connecting two transmission lines comprising a connector consisting of two parts, each part being connectable to one respective transmission line and adapted to cooperate releasably at two radially separated surfaces with the other part of the connector.

In a second aspect the connection apparatus including a first connector, comprising., a first transmission line of required impedance; and a first engagement member retained in relation to the first transmission line and having radially separated first and second cooperation means; and a second connector, comprising a second transmission line of the required impedance, adapted to cooperate in use with the first transmission line for the transmission of signals, and including means for cooperating with the first cooperating means; and a second engagement member, retained with respect to the second transmission line for relative longitudinal displacement therewith and including means for cooperation with the second cooperation means.

Preferably, the second engagement member is retained so as to allow a chosen degree of relative longitudinal sliding displacement but the displacement may be produced by any suitable means, for example a screw thread arrangement.

Advantageously the second engagement member is retained by means of a retaining means which forms part of an imaginary sphere having a centre at the point of connection of the inner conductors, and may include one or more abutment portion on one transmission line and complimentary portions on the engagement members.

DESCRIPTION OF THE DRAWINGS

An embodiment of the invention will now be described by way of example only with reference to the accompanying drawings in which.

DESCRIPTION OF PREFERRED EMBODIMENTS OF THE INVENTION

Figure 1:
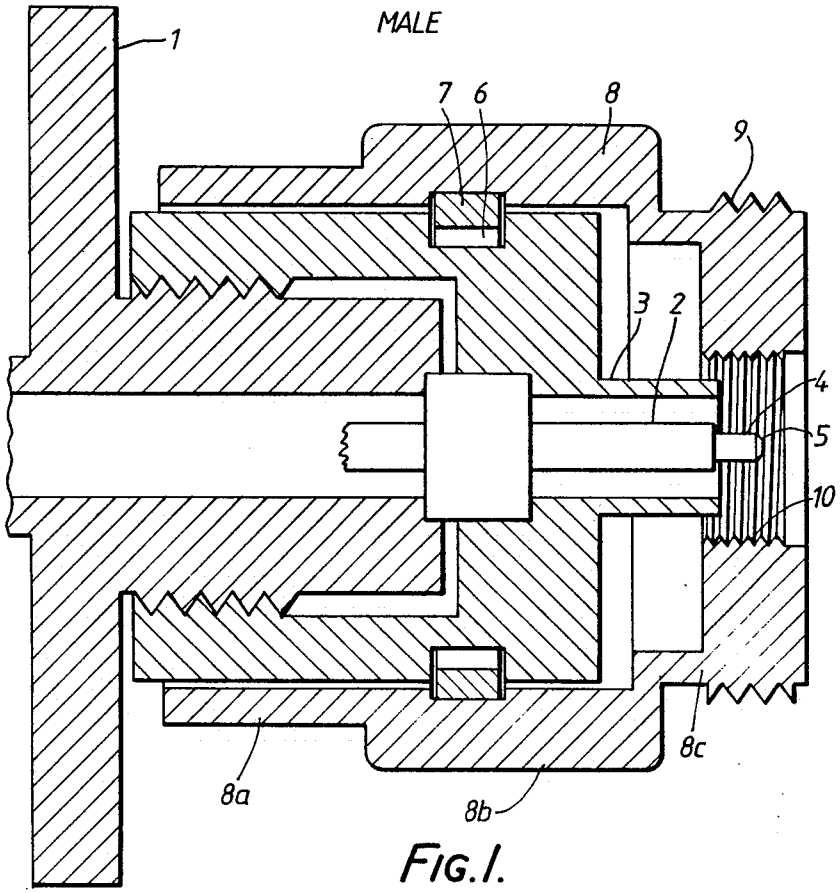
FIG. 1 shows a male connector.

Referring to FIG. 1 there is shown a male connector for use with signals of the type which are generally passed along a coaxial transmission line, such as UHF or microwave signals. Connectors are required when two cables are required to be joined or a cable is required to be connected to an input or output port of a piece of equipment. The connector shown in the Figure is adapted for use on the equipment end of a system and includes a mounting block 1 including a flange, for mounting against the equipment. A transmission section is included which comprises a central solid conductor 2 and an outer conductor 3. The outer conductor is electrically connected to the mounting member 1. The central conductor 2 has a narrowed end portion 4 which includes a tapered tip 5. A transverse groove 6 is cut in the outer conductor 3 in which sits a location element 7 for locating and retaining a rotating nut 8 which is freely rotatable around the conductors and is divided into three integral portions. The first portion **8*a*, towards the rear of the connector is knurled, the second portion 8*b* contains hexagon flats for use with a spanner and a third portion 8*c*, narrower than portions 8*a* and 8*b* includes external and internal screw threads, 9 and 10 respectively. As is shown in the Figure, this portion is arranged in use to project beyond the end of conductor 5, which itself projects beyond that of conductor 3. Typically, the inner thread 10** is identical to that of a standard 3.5 mm connector and the external thread is that of a standard 7 mm connector.

Figure 2:
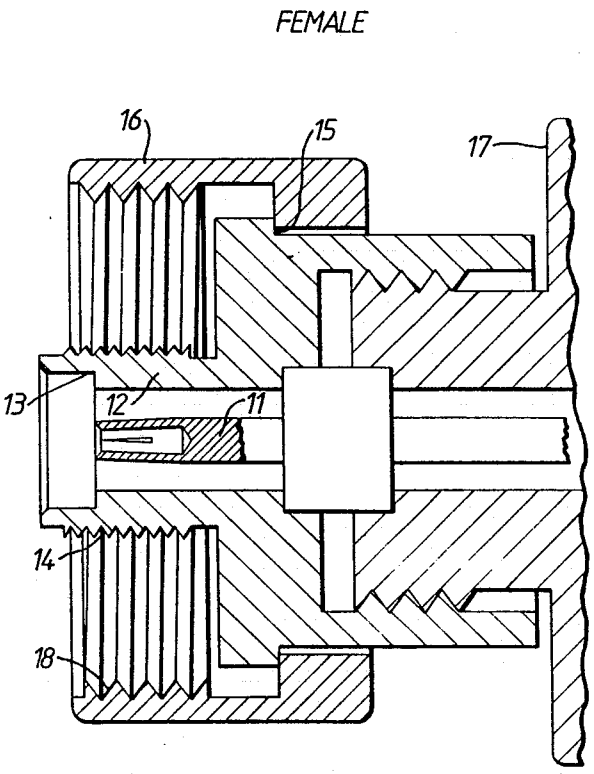
FIG. 2 shows a female connector.

The associated female connector is shown in FIG. 2. This also includes a transmission line including a central pin 11 and outer conductor 12. Pin 11 is hollow at its end for receiving the narrowed portion 4 of the male connector pin and outer conductor 12 has a shoulder 13 formed by a narrowing of its diameter towards its end and in line with the end of pin 11. It is thus seen that in use the end 4 of the male pin is inserted into the complimentary portion in pin 11 whilst the end of outer conductor 3 abuts against shoulder 13. Outer conductor 12 also has an outer screw thread 14 adapted to cooperate with screw thread 10 of the male member. A further shoulder 15 is provided on the outer conductor by means of a narrowing of its rear portion and this is designed to retain in place an outer nut 16 such that the nut is slideably located on the conductor for movement between the forward position shown and a rearward position determined by a rear flange 17 which may form part of the coaxial cable to which the connector is linked. Nut 16 has an inner screw thread 18 for cooperation with screw thread 9 of the male connector.

In order to connect the male connector to the rugged female, the female nut 16 is first retracted to its rear position. The male nut is then rotated in order to engage the male and female connectors by means of the small diameter threads. It is seen that an electrical connection is made once the male nut is correctly torqued up and the female nut 16 is subsequently moved forward and screwed onto the male nut in order to provide mechanical rigidity to the system.

Figure 3:
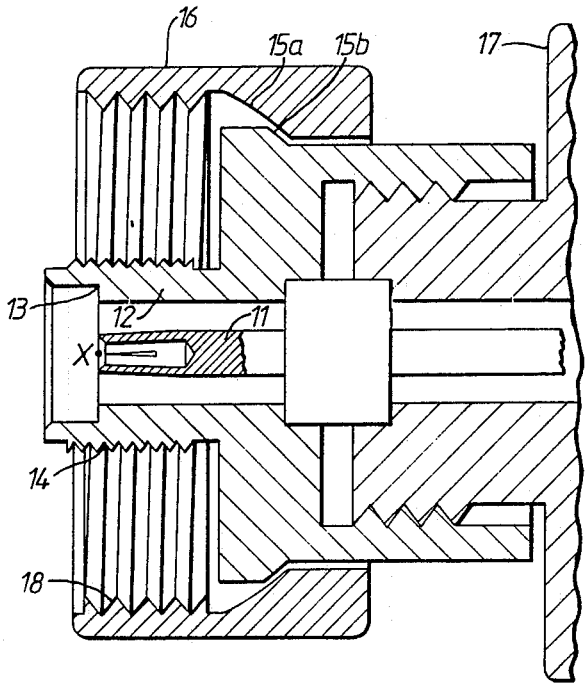
FIG. 3 shows a modified female connector.

In order that the tightening of the female nut does not distort the axis of the female connector, careful attention must be paid to the design of the shoulder 15 which retains the female sliding nut 16. If it is not exactly perpendicular to the axis of the system and in particular with respect to the mating plane then errors of non-repeatability may be introduced. In order to overcome this problem a modified apparatus may be utilised. FIG. 3 shows one embodiment of such a modified connector in which the ridge 15*a* forms part of a sphere having centre at the centre of the mating plane, shown at X on FIG. 3. The profile of the female nut is complimentary, as shown at 15*b*. It is seen that in such a case the tolerance of the female nut need not be as critical since tightening at any angle will not cause any distortion. Thus, even if the nut is on slightly skew the electrical connection will remain sound. This principle is similar to that of a ball joint.

We claim:

1. Connection apparatus comprising:

a first connector including a first transmission line of predetermined impedance, a first engagement member retained relative to the first transmission line and having first and second radially separated attachment means; and a second connector including a second transmission line of said predetermined impedance, adapted to co-operate in use with the first transmission line for the transmission of signals therebetween, and including first attachment means releasably attachable to said first attachment means on said first engagement member and a second engagement member retained relative to the second transmission line for longitudinal displacement relative to said second transmission lien and including second attachment means releasably attachable to said second attachment means on said first engagement member sequentially with said first attachment means.

2. Connection apparatus as claimed in claim 1 wherein the relative longitudinal displacement is sliding displacement.

3. Connection apparatus as claimed in claim 1 wherein the attachment means are screw threads.

4. Connection apparatus as claimed in claim 1 wherein the second engagement member is retained by means of a retaining means which forms part of an imaginary sphere having a centre at the point of connection of the inner conductors.

5. Connection apparatus as claimed in claim 4 wherein the retaining means includes one or more abutment portions on one transmission line and complimentary portions on the engagement member.

6. Means for connecting two transmission lines including a connector comprising first and second parts, each of said first and second parts being connectable to a respective transmission line to be connected, first attachment means on said first part, first attachment means on said second part releasably attachable to said first attachment means on said first part, second attachment means on said first part spaced radially from said first attachment means on said first part, second attachment means on said second part radially spaced from and movable longitudinally with respect to said first attachment means on said second part and releasably attachable to said second attachment means on said first part sequentially with said first attachment means.

7. A coupling for a coaxial cable including a pair of connectors with interengaging contacts, comprising:

a female connector including (i) a tubular engagement member including an axially located inner conductor and a tubular outer conductor surrounding and electrically insulated from said inner conductor, said outer conductor having a shoulder located between and extending above cable and connector mating portions of said outer conductor, said connector mating portion having outer screw threads and a smaller outer diameter than the outer diameter of said cable portion, said inner conductor extending into said connector mating end, and (ii) a tubular outer nut portion including a rear portion having a collar positionable over said cable portion of said outer conductor with an inner diameter less than said diameter of said shoulder portion of said outer conductor and greater than said outer diameter of said cable portion of said outer conductor, a front portion of said outer nut positionable over said connector mating portion of said engagement member and having a threaded inner surface with an inner diameter greater than said diameter of said shoulder portion of said outer conductor whereby said collar portion is longitudinally slidable along, and rotatable on, said cable portion of said engagement member; and a male connector including (i) a tubular base member including an axially located inner conductor longitudinally engagable with said center conductor of said male connector and a tubular outer conductor surrounding and electrically insulated from said inner conductor, and (ii) an outer nut portion positioned over and rotatable about said tubular base member, a connector mating end of said outer nut having a central void through which said center conductor extends for engaging said central conductor of said male connector, said central void having inner threads for engaging said treads of said connector mating portion of said male connector, said outer nut further having outer treads concentric with said central void inner threads for engaging said inner threads of said male connector outer nut.

8. A coaxial connector, comprising:

a tubular engagement member including an axially located inner conductor and a tubular outer conductor surrounding and electrically insulated from said inner conductor, said outer conductor having a shoulder located between and extending above cable connector mating portions of said outer conductor, said connector mating portion having outer screw threads and a smaller outer diameter than the outer diameter of said cable portion, said inner conductor extending into said connector mating ends; and an outer nut slidably positionable over said outer conductor of said engagement member, a rear portion of said outer nut having a collar portion with an inner diameter (i) less than said diameter of said shoulder portion of said outer conductor and (ii) greater than said outer diameter of said cable portion of said outer conductor, a front portion of said outer nut slidably positionable over said connector mating portion of said engagement member and having a threaded inner surface with an inner diameter greater than said diameter of said shoulder portion of said outer conductor whereby said collar portion is longitudinally slidable along, and rotatable on, said cable portion of said engagement member.

* * * * *